United States Patent [19]

Lin

[11] 4,387,439

[45] Jun. 7, 1983

[54] SEMICONDUCTOR ANALOG MULTIPLIER

[76] Inventor: Hung C. Lin, 8 Schindler Ct., Silver Spring, Md. 20903

[21] Appl. No.: 221,992

[22] Filed: Jan. 2, 1981

Related U.S. Application Data

[63] Continuation of Ser. No. 50,069, Jun. 19, 1979, abandoned.

[51] Int. Cl.[3] ..... G06G 7/12; G06G 7/164

[52] U.S. Cl. ..... 364/841; 307/498; 328/160; 364/843; 364/862

[58] Field of Search ..... 364/841, 843, 844, 862; 328/142, 144, 160; 307/490, 498, 499–502

[56] References Cited

U.S. PATENT DOCUMENTS

| | | | |
|---|---|---|---|
| 2,906,459 | 9/1959 | Lovell | 364/843 |
| 3,393,308 | 7/1968 | Cope | 364/843 X |
| 3,956,643 | 5/1976 | Hite | 307/498 |
| 4,015,140 | 3/1977 | Milkovic | 307/498 |
| 4,032,767 | 6/1977 | Lagnado | 364/841 X |
| 4,053,798 | 10/1977 | Koicke et al. | 307/288 X |
| 4,071,777 | 1/1978 | Herrmann | 307/498 |
| 4,100,432 | 7/1978 | Miyakawa et al. | 328/160 X |
| 4,101,966 | 7/1978 | Uzunoglu | 328/160 X |

*Primary Examiner*—Joseph F. Ruggiero

[57] ABSTRACT

Analog multiplier utilizing the square-law characteristic of MOSFET is disclosed. The product is obtained by taking the difference of squares of the sum and difference of two quantities. The square of difference can be obtained by a pair of complementary MOSFETs in series.

6 Claims, 5 Drawing Figures

SEMICONDUCTOR ANALOG MULTIPLIER

This is a continuation of application Ser. No. 50,069 filed June 19, 1979 abandoned.

BACKGROUND OF THE INVENTION

In mathematical operation, multiplication and division are one of the major functions to perform. The multiplication function is customarily achieved by multiple additions in digital computers. Such a procedure involve large number of operations and require a great deal of hardware.

One of the areas where multiplication is indispensible is in signal processing, where the products of two variables are summed. Recent development in charge coupled devices makes it feasible to sum a large number of quantities simultaneously. However, for correlation and convolution, the quantities must be multiplied before the products are summed. Thus, an analog multiplier is needed for such applications.

In a charge-coupled device the signals which should be multiplied are derived from a floating gate. The equivalent circuit for such a floating gate is a capacitor, which has high impedance. The voltages derived from the floating gates should be applied to a high impedance multiplier so as to preserve the amplitude.

A conventional conductance multiplier operates a MOSFET near the origin of its V-I characteristics with one multiplicant appearing as gate voltage and the other multiplicant appearing as drain voltage. The drawback of this kind of circuit is that the drain voltage must be fed to the low drain impedance. What is needed is a multiplier which can be fed from a high impedance source.

SUMMARY OF THE INVENTION

A primary object of the invention is to perform analog multiplication. Another object of the invention is to multiply two quantities from high impedance sources. Still another object of this invention is to multiply two quantities with common ground.

These objects are achieved in this invention utilizing the nonlinear characteristics of semiconductor devices. The square-law characteristic of a field effect transistor is utilized. The difference and the sum of the multiplicants are squared, and the difference of these squares give the product.

DETAILED DESCRIPTION OF THE PREFERRED EMBODIMENT

Figure 1:
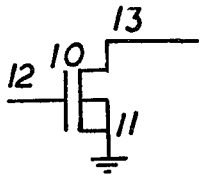
FIG. 1 is a schematic diagram of a single MOSFET squaring circuit of the present invention. A difference or sum signal applied to the gate yields a drain current proportional to the square of the signal.

The underlying principle of this invention utilizes the square-law characteristic of an MOS transistor operating in current saturation (pentode) region. The drain current $I_D$ is given as:

$$I_D = K(V_{GS} - V_T)^2 \quad (1)$$

where $V_{GS}$ is the dc gate to source voltage, $V_t$ is the threshold voltage and K is a constant.

If the sum of two quantities X and Y is made to equal to $V_{GS}$ in transistor A, the drain current becomes $$I_{DA} = K(X + Y - V_T)^2 \quad (2)$$

If the difference of X and Y is applied to another identical transistor B the drain current is $$I_{DB} = K(X - Y - V_T)^2 \quad (3)$$

The difference in drain current is $$\Delta I = I_{DA} - I_{DB} = K(4XY - 4YV_T) \quad (4)$$

The product term 4XY is the desired output.

The second term 4 $YV_T$ is an undesired quantity and should be balanced out. If we introduce another current differential $\Delta I'$ with the X input set to zero, then $$\Delta I' = K4YV_T \quad (5)$$

Subtract $\Delta I'$ from $\Delta I$, one obtains the desired output 4XY.

In actuality signals such as that derived from a CCD contain a d-c component (the fat zero) and an a-c signal. However, the d-c components for the X signal and the Y signal can be lumped into the threshold voltage term. Thus, the term $V_T$ in Eqs. (1) through (5) is really the algebriac sum of the actual threshold voltage and the two fat zeros.

The circuit for deriving the square law drain current is a simple common source MOS transistor 10 as shown in FIG. 1 having a drain 13, a gate 12 and a source 11. The signal such as that derived from a floating gate of a CCD is applied to the gate. The drain is connected in common to the drains of other stages.

Figure 2:
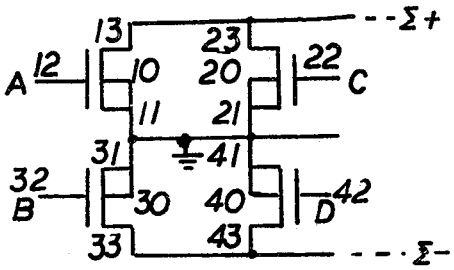
FIG. 2 is a schematic diagram having four MOSFETs in the same mode of operation as FIG. 1 for analog multiplication. Different combinations of the two input signals are applied to the gates of the four MOSFETs to cancel out the unwanted terms yielding only the desired product term.

Four MOSFETs 10, 20, 30 and 40 can be used for implementing the square-law differential current multiplication as shown in FIG. 2. The respective drains are 13, 23, 33, 43; respective gates, 12, 22, 32, 42; respective sources, 11, 21, 31, 41. The four signals are:

(A) $V_{01} + V_x + V_{02} + V_y$
(B) $V_{01} + V_{02} - V_y$
(C) $V_{01} + V_x + V_{02} - V_y$
(D) $V_{01} + V_{02} + V_y$ where $V_x$, $V_y$ are the a-c signals and $V_{01}$, $V_{02}$ are the d-c levels. These signals are applied to the four separate gates 12,22,32,42. The drains for the first two signals $\Sigma+$ are connected together, and that the last two signals $\Sigma-$ are also connected together. The two separate common drains are connected to two current summing points, e.g., operational amplifiers. The differential output of these two amplifiers is the desired output.

Alternatively, the four signals can be multiplexed at the input of the single MOSFET in FIG. 1. The common output for the $V_{01}+V_x+V_{02}+V_y$ and $V_{01}+V_{02}-V_y$ signals are sampled and held. Separately, the common output for the $V_{01}+V_x+V_{02}-V_y$ and $V_{01}+V_{02}+V_y$ signals are sampled and held. The differential output of the two sampled-hold circuits gives the product output.

The advantages of the single channel multiplication scheme are: (1) simplicity, (2) cancellation of any nonuniformity of the device parameters. The disadvantage is that the multiplexing limits the maximum frequency of operation.

Figure 4:
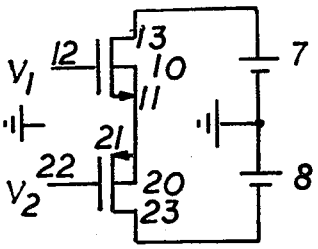
FIG. 4 is a schematic diagram of another embodiment of the present invention using a pair of complementary MOSFETs. The two signals are applied to the two inputs and the drain current is proportional to the square of the difference signal.

When sum and difference signals are not available but only the signals themselves are available, then the single transistor squaring circuit of FIG. 1 is not adequate and a different scheme must be used. For the implementation of this scheme, a complementary MOS transistor pair is used. The basic circuit is to connect the two complementary MOS transistors in series as shown in FIG. 4. The n-channel MOSFET 10 has a drain 13, a gate 12 and a source 11. The p-channel MOSFET 20 has a drain 23, a gate 22 and a source 21. The two sources 11 and 12 are connected together and floating in that this common connection is not connected to any other elements or power supplies. The drain 13 is connected to a positive power supply 7 with respect to ground and the drain 23 is connected to a negative power supply 8 with respect to ground. The power supplies should be equal or exceed the voltage difference $V_{GS}-V_T$ so that the MOSFETs are operating in the pentode or current saturation region. The substrates of the MOSFETs can be connected to the respective substrates as shown in FIG. 4 or connected to a fixed potential.

When two signals $V_x$ and $V_y$ are applied to the gates of two series CMOS transistors, the current must be the same. If the transistors are in current saturation, the current varies as the square of the gate to source voltage. Thus, the drain currents for the two symmetrical transistors are $$I_{D1}=K(V_{GS01}+V_x-V_S-V_{T1})^2 \text{ for n-channel} \quad (6)$$

$$I_{D2}=K(V_{GS02}-V_y+V_S+V_{T2})^2 \text{ for p-channel} \quad (7)$$

$V_{GS01}$ and $V_{GS02}$ are the dc gate to source voltages of MOSFETs 10 and 20 respectively. Equating these two currents yields and $V_{T1}$ and $V_{T2}$ are the respective threshold voltages.

$$V_S=\frac{(V_{GS01}+V_x-V_{T1})+(V_y+V_{GS02}-V_{T2})}{2} \quad (8)$$

When $V_S$ is substituted back into the current equation, we have a drain current $$I_{DA}=K\left[\frac{(V_{GS01}+V_x-V_{T1})-(V_y+V_{GS02}-V_{T2})}{2}\right]^2 \quad (9)$$

$$=K\frac{(V_A+V_x-V_y)^2}{2}$$

Note the current varies as the square of $V_x-V_y$. Although this relationship is derived for symmetrical transistor, it can be proven that it is also true for unsymmetrical transistors.

If the input signal $V_y$ is inverted, the drain current becomes $$I_{DB}=K\frac{(V_B+V_x+V_y)^2}{2} \quad (10)$$

The difference of these two currents are $$\Delta I=IDB-I_{DA}=K[V_y(V_y(V_B+V_A)+V_xV_y] \quad (11)$$

If the two complementary transistors are not symmetrical with a ratio m for the values of K, then we can represent and equate the drain currents.

The solution for the common source voltage is $$V_S=\frac{V_I+m\,V_{II}}{1+m} \quad (12)$$

where $$V_I=V_{GS01}+V_x-V_{T1} \text{ and } V_{II}=V_y-V_{GS02}-V_{T2} \quad (13)$$

and the current is $$I_D=\frac{Km(V_I-V_{II})^2}{1+m} \quad (14)$$

Note that the drain current remains proportional to the square of input voltage difference.

Figure 3:
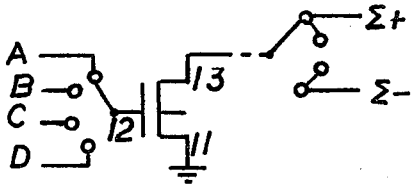
FIG. 3 is a schematic diagram of a multiplexed version of FIG. 2.

In FIG. 3, the substrate connection is not shown. The substrate can either be connected to the common or to a fixed d-c potential. They threshold voltages in the two cases may be somewhat different.

AC signals are often superimposed on a dc quantities such as the "fat zero" of a CCD when two such signals are multiplied, the resultant product contains both the desirable ac product and some extraneous quantities. Thus if $V_1=V_x+V_{x0}$, and $V_2=V_y+V_{y0}$ where $V_x$, $V_y$ are the a-c signals and $V_{x0}$ and $V_{y0}$ are the d-c components. Then the product $I=V_1 \cdot V_2=V_xV_y+V_xV_{y0}+V_yV_{x0}+V_{x0}V_{y0}$.

Figure 5:
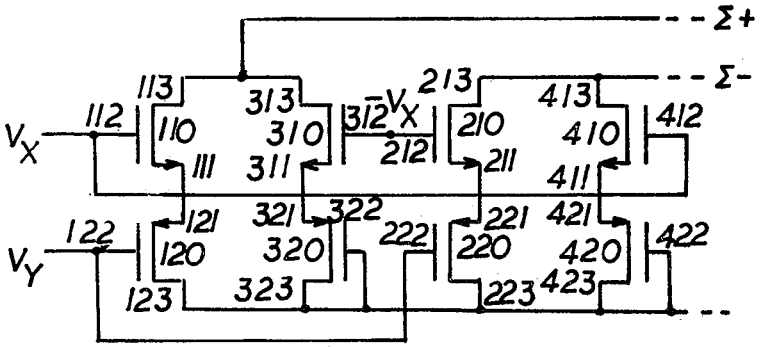
FIG. 5 is a schematic diagram having four pairs of complementary MOSFETs shown in FIG. 4. Different combinations of the two input signals are applied to the gates of the MOSFETs to cancel out the unwanted terms, yielding only the desired product term.

The undesirable quantities can be balanced out sequentially or simultaneously by using balancing circuits. FIG. 5 shows one such balancing circuit. Four branches of squaring complementary MOSFETs are used. The first branch is the same as that described in FIG. 3. The second branch consists of an an-channel MOSFET 310 with drain 313, gate 312 and source 311, and a p-channel MOSFET 320 with drain 323, gate 322 and source 321. The gate 312 of MOSFET 310 is connected to the complement of signal $V_x(-V_x)$ and the gate 322 of MOSFET 320 is connected to the negative d-c supply 6. The third branch consists of an n-channel MOSFET 210 with drain 213, gate 212, and source 211 and a p-channel MOSFET 220 with drain 223, gate 222, and source 221. The gate 212 is connected to $-V_x$ and the gate 222 is connected to $V_y$. The fourth branch consists of n-channel MOSFET 410 with drain 413, gate 412 and source 411, and a p-channel MOSFET 420 with drain 423, gate 422 and source 421. The gate 412 is connected to $V_x$, and the gate 422 is connected to the negative supply.

When d-c voltages $V_{x0}$ and $V_{y0}$ are superimposed on the signals $V_x$ and $V_y$ respectively, the voltages appearing at the gates are $V_x+V_{x0}$, $V_y+V_{y0}$, and the complements are $V_{x0}=V_x$ and $V_{y0}-V_y$. Then the products in the four branches are:

$$A: (V_{x0}+V_x)(V_{y0}+V_y) = V_xV_y + V_xV_{y0} + V_yV_{x0} + V_{x0}V_{y0}$$

$$B: (V_{x0}-V_x)(V_{y0}) = -V_yV_{y0} + V_{x0}V_{y0}$$

$$C: (V_{x0}-V_x)(V_{y0}+V_y) = V_xV_y + V_xV_{y0} - V_yV_{x0} - V_{x0}V_{y0}$$

$$D: (V_x+V_{x0})(V_{y0}) = -V_xV_{y0} - V_{x0}V_{y0}$$

The sum of the drain currents of the last two branches, $\Sigma-$ is substracted from the sum of the drain current of the first two branches $\Sigma+$. The net current is $2V_xV_y$.

As in FIG. 3, the functions of the four branches can be performed with only one branch using time-division multiplexing. Thus, the four sets of multiplicands are sequentially applied to the respectively gates.

In FIGS. 1, 2 and 5, certain conductivity-type channel MOSFETs were described. It should be understood that the description applies equally well if the conductivity-types are reversed. In the foregoing description all the MOSFETs are active devices having square law characteristics.

I claim:

1. Electronic circuit comprising no less than a pair of nonlinear complementary but not necessarily symmetrical MOSFETs having n-type and p-type channels respectively, each device having a drain; a gate and a source, said drain of said n-channel MOSFET being connected to a positive potential, said output terminal drain of said p-channel MOSFET being connected to a negative potential, two said potentials being of sufficient voltages to bias two said MOSFETs into square-law-mode, said two sources of said pair being connected together and floating, said two gates being connected to two separate input signals which are referenced to a potential intermediate between said positive potential and said negative potential, and means for sensing output from said drain terminals.

2. Electronic circuit as defined in claim 1 wherein said output varies as the product of two said input signals.

3. Electronic circuit as defined in claim 1 wherein said input signals are voltages and said output is a current.

4. Electronic circuit as defined in claim 1 wherein an active element consists of two pairs of complementary but not necessarily symmetric MOSFETs, one said signal being applied in phase to the gates of both said n-channels MOSFETs, another said signal being applied in opposite phase to the gates of said p-channel MOSFETs.

5. Electronic circuit as defined in claim 1 wherein said active element consists of four pairs of complementary but not necessarily symmetrical MOSFETs, one said signal being applied to the gates of said n-channel MOSFETs of said first and second pairs, second said signal being applied to the gates of said p-channel MOSFETs of said first and third pairs, second said signal being applied in opposite phase to the gates of said p-channel MOSFETS of said second and fourth pairs, the gates of said n-channel MOSFETs of said second and fourth pairs being connected to respective drains.

6. Electronic circuit as defined in claim 1 wherein said active element consists of a pair of complementary but not necessarily symmetrical MOSFETS, means for applying different combinations of said signals to gates of said MOSFETS, one said signal being applied to the gate of said n-channel MOSFET and said second signal being applied to the gate of said p-channel MOSFET in first time sequence, said first signal being applied to the gate of said n-channel MOSFET and said second signal being applied in opposite phase to the gate of said p-channel MOSFET in second time sequence, said second signal being applied to the gate of said n-channel MOSFET and the gate and the drain of said p-channel MOSFET being connected together in third time sequence, said second signal being applied in opposite phase to the gate of said n-channel MOSFET and the gate and the drain of said p-channel MOSFET being connected together in fourth time sequence.

* * * * *